United States Patent [19]

Vannucci

[11] Patent Number: 4,461,406

[45] Date of Patent: Jul. 24, 1984

[54] CONTAINER WITH RECIPROCABLE DISPENSING TUBE

[75] Inventor: Osvaldo Vannucci, Sao Paulo, Brazil

[73] Assignee: American Home Products Corporation, New York, N.Y.

[21] Appl. No.: 387,391

[22] Filed: Jun. 11, 1982

[30] Foreign Application Priority Data

Dec. 2, 1981 [BR] Brazil ..... 8107847

[51] Int. Cl.[3] ..... B65D 37/00; B67D 5/60

[52] U.S. Cl. ..... 222/211; 222/464; 222/513

[58] Field of Search ..... 222/211, 464, 513, 527, 222/529, 530, 538, 539, 206, 511, 518, 566; 206/217; 220/90.2

[56] References Cited

U.S. PATENT DOCUMENTS

| | | | |
|---|---|---|---|
| 125,813 | 4/1872 | Hauck | 222/211 |
| 942,306 | 12/1909 | Clarke | 239/33 |
| 2,198,933 | 4/1940 | Damkroger et al. | 222/529 X |
| 2,792,976 | 5/1957 | Stewart | 222/569 |
| 3,326,695 | 6/1967 | Neuhauser | 239/33 |
| 3,349,955 | 10/1967 | Cornelius | 229/7 S |
| 3,940,036 | 2/1976 | Parker | 222/530 |
| 4,356,927 | 11/1982 | Cooper et al. | 220/90.2 |

FOREIGN PATENT DOCUMENTS 159624 1/1971 Spain .

*Primary Examiner*—Joseph J. Rolla
*Assistant Examiner*—Michael S. Huppert
*Attorney, Agent, or Firm*—Joseph Martin Weigman

[57] ABSTRACT

There is described a container for dispensing liquids in which an elongated, resilient, delivery tube is positioned within the container in a deflected and compressed condition, so that when a closure is removed from an opening in the container the upper end part of the delivery tube is urged out of the container by its own resilience. The delivery tube is then grasped and pulled outwardly until cooperating formations on the lower end of the delivery tube and the container nozzle form a seal therebetween. A flexible wall or diaphragm may be provided to expel fluid from the container. After use, the delivery tube is replaced within the container by pushing the first end part, and a cap is placed over the opening in the container.

4 Claims, 4 Drawing Figures

CONTAINER WITH RECIPROCABLE DISPENSING TUBE

The present invention refers to containers for liquids, and is particularly concerned with dispensing containers for lubricants, sealants, solvents, etc. which include a spout to enable small quantities of liquid to be dispensed with precision in restricted spaces.

Hitherto, containers, particularly in the case of lubricating oil, have been provided with an elongated flexible delivery tube fixed to a metal, liquid-containing can. The fact that the delivery tube necessarily extends a great distance out of the can poses problems in that greater space is required for storage and transportation of the cans. In some cases, this problem has been surmounted by providing a removable delivery tube, but this solution suffers from the disadvantage that the delivery tube is easily lost.

The present invention seeks to overcome the problems of the prior art by providing a sealed, inviolable container for liquids, the container having a resilient flexible delivery tube retained within the container and, after opening the container, being extendable therefrom, the tube being entirely within the container prior to opening, and, on opening, being partially extended therefrom by its inherent resilience.

An embodiment of the present invention will now be described with reference to the accompanying drawings, in which.

Figure 1:
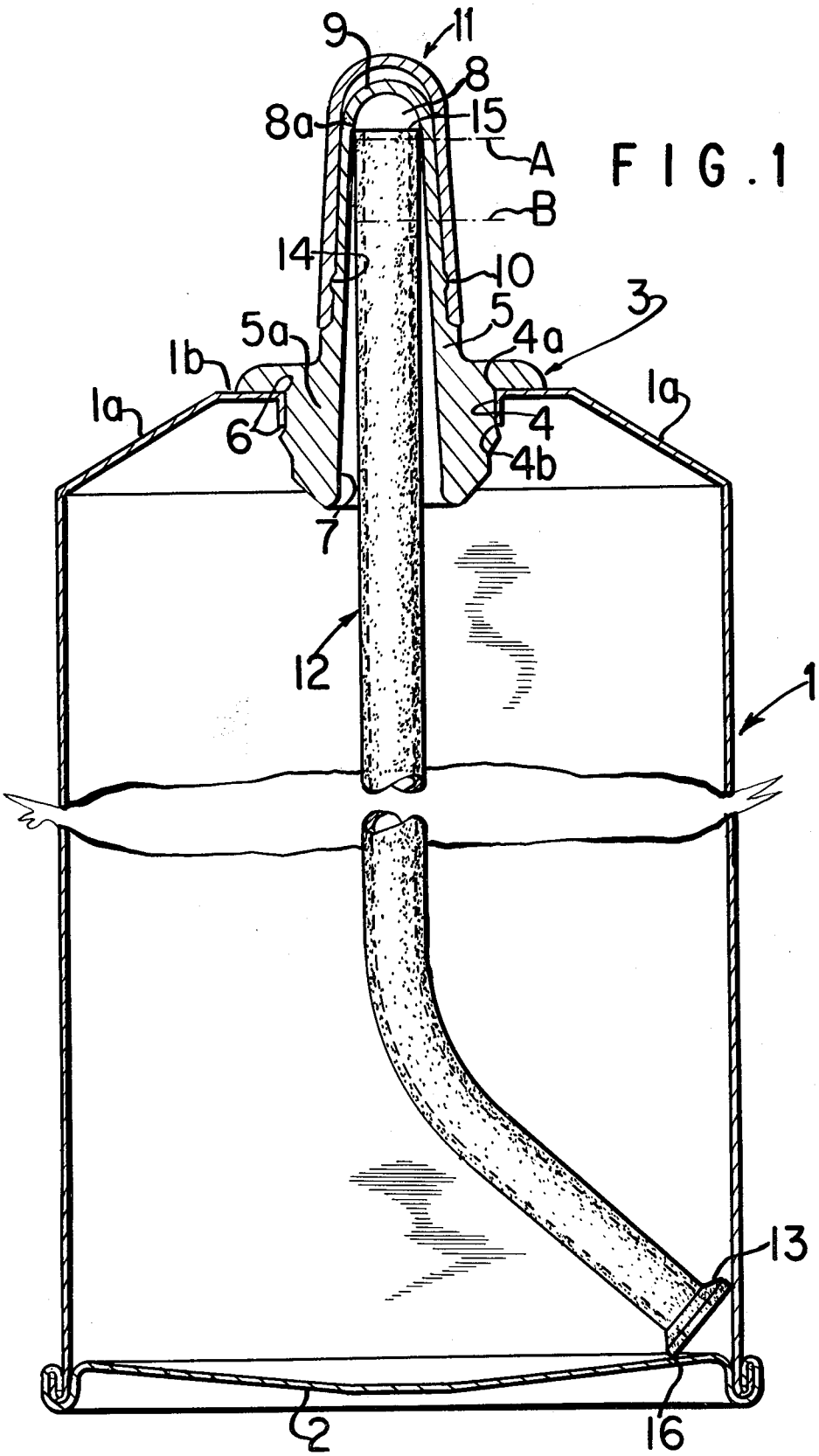
FIG. 1 is a vertical sectional view of a sealed container.

Referring to FIG. 1, there is shown a metal can 1 which, in the preferred embodiment, is circular in cross section and has a frusto-conical upper end part 1*a* and a flexible metal diaphragm 2 at its base. The diaphragm 2 aids the expulsion of fluid from the can in use. The can 1 may have alternative cross-sectional shapes, that is, it may be rectangular, elliptical, hexagonal, or the like. In the case of rectangular-section cans, or other shapes which have large planar sidewalls, it may be unnecessary to provide the diaphragm 2 to expel liquid, as pressure on the can sides may be sufficient.

At its upper end 1*a*, the can 1 is provided with a closure insert 3 of plastic material. The closure insert 3 is an elongated tapered tube 5 with an enlarged base 5*a*, which is supported in an opening formed in the upper flat surface 1*b* of the can 1. As may be seen in FIG. 1, the opening is defined by an inwardly extending wall 4, and abutments 6 are provided on the enlarged base 5*a* to cooperate with the upper and lower ends 4*a*, 4*b*, of the wall to anchor the closure insert 3 securely to the can 1.

The closure insert 3 is formed with a tapering axial bore 7, larger at its end within can 1 than at its upper end 8. The upper end 8 of the bore 7 is closed by a hemispherical wall 9, integral with the tapering tube 5 and joined thereto by a relatively narrow, parallel-sided portion 8*a*. An external circumferential rib 10 encircles the tube 5 intermediate its length, and serves to engage an internal groove 14 in a cap 11 which covers the upper end 8 and wall 9 of tube 5.

Positioned within the can 1 is a delivery tube 12, which is preferably a flexible plastic conduit. At the first, or lower, end of the delivery tube is a radially enlarged conical ring 13, the external diameter of which is slightly smaller than the diameter of bore 7 at its lower end, but larger than the diameter of the bore 7 at its upper end 8. The upper, or second, end 15 of the tube 12 is positioned within the bore 7 of insert 3, the external diameter of tube 12 is sized as to permit the tube 12 to extend upwardly into the tapering bore 7 as far as the narrow portion 8*a* adjoining the hemispherical wall 9. It is important to note that the length of delivery tube 12 is greater than the distance between the wall 9 and the diaphragm 2 at the bottom of the can 1, thus the tube is resiliently bent when within the can to assume the position shown in FIG. 1, abutting the can at the lower end 16 of the tube 12.

Figure 2:
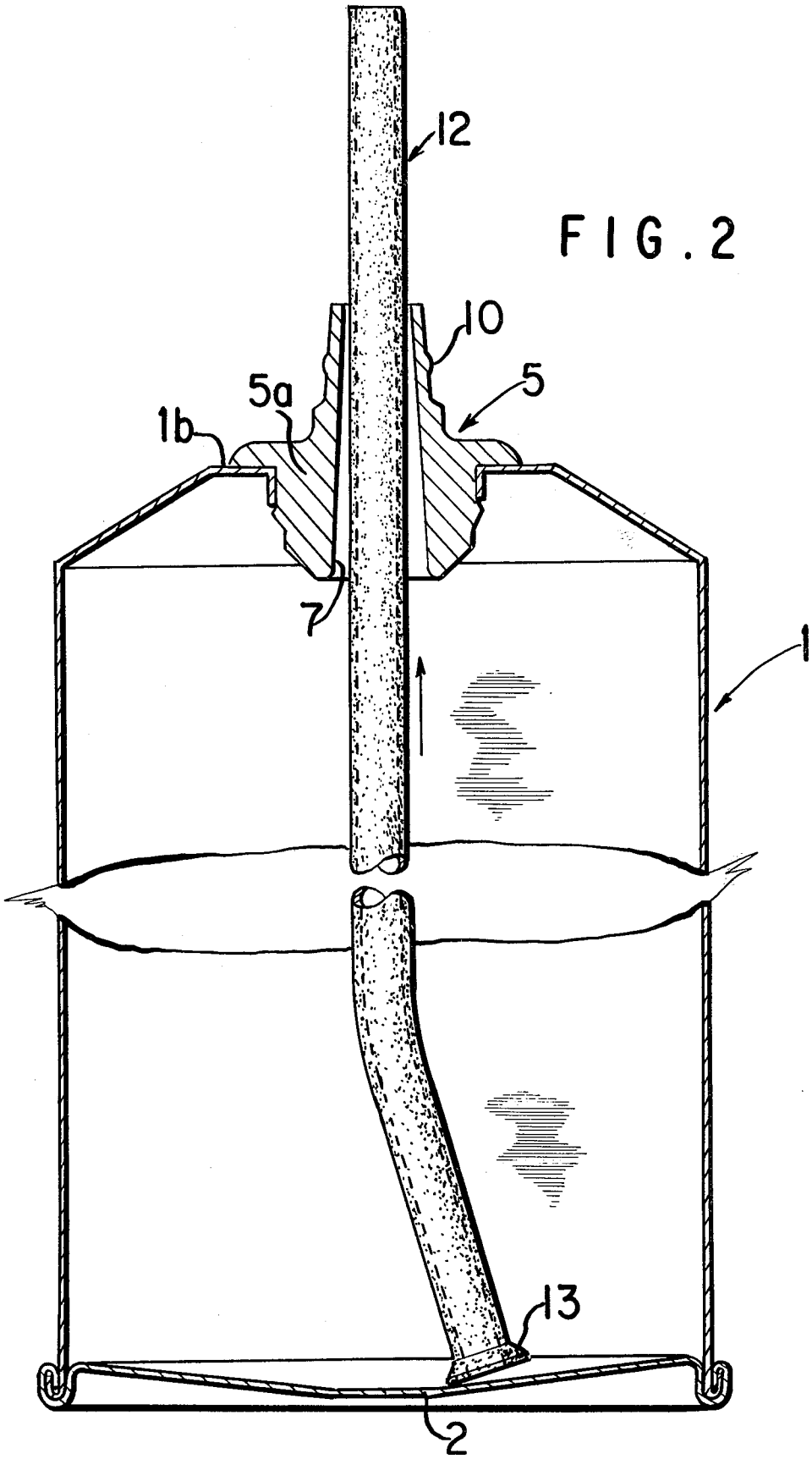
FIG. 2 is a sectional view of the container of FIG. 1 after opening.

To open the container, the cap 11 is removed, and the upper end of the tapered tube 5 is cut off, taking care to cut above the circumferential rib 10. Preferably, the cut is made between the lines A and B. Due to the resilience, or elasticity, of the tube 12, removal of the upper part of tapering tube 5 permits the end of the tube 12 to extend upwardly out of the tapered bore 7 of the insert 3, as is shown in FIG. 2.

To use the container, the upper end of the tube 12 is grasped and pulled, until the enlarged ring 13 at the lower end of tube 12 enters the tapered bore 7 of insert 3. Further slight pulling causes the ring 13 to move upwardly into the bore until a tight sealing engagement is achieved between the bore wall and the ring, as is shown in FIG. 3.

Preferably, the bore 7 and ring 13 are so dimensioned that a tight fit is achieved while the ring is still within a part of the bore surrounded by the base 5*a* of the insert, so that rigid support for the bore walls is available.

Figure 3:
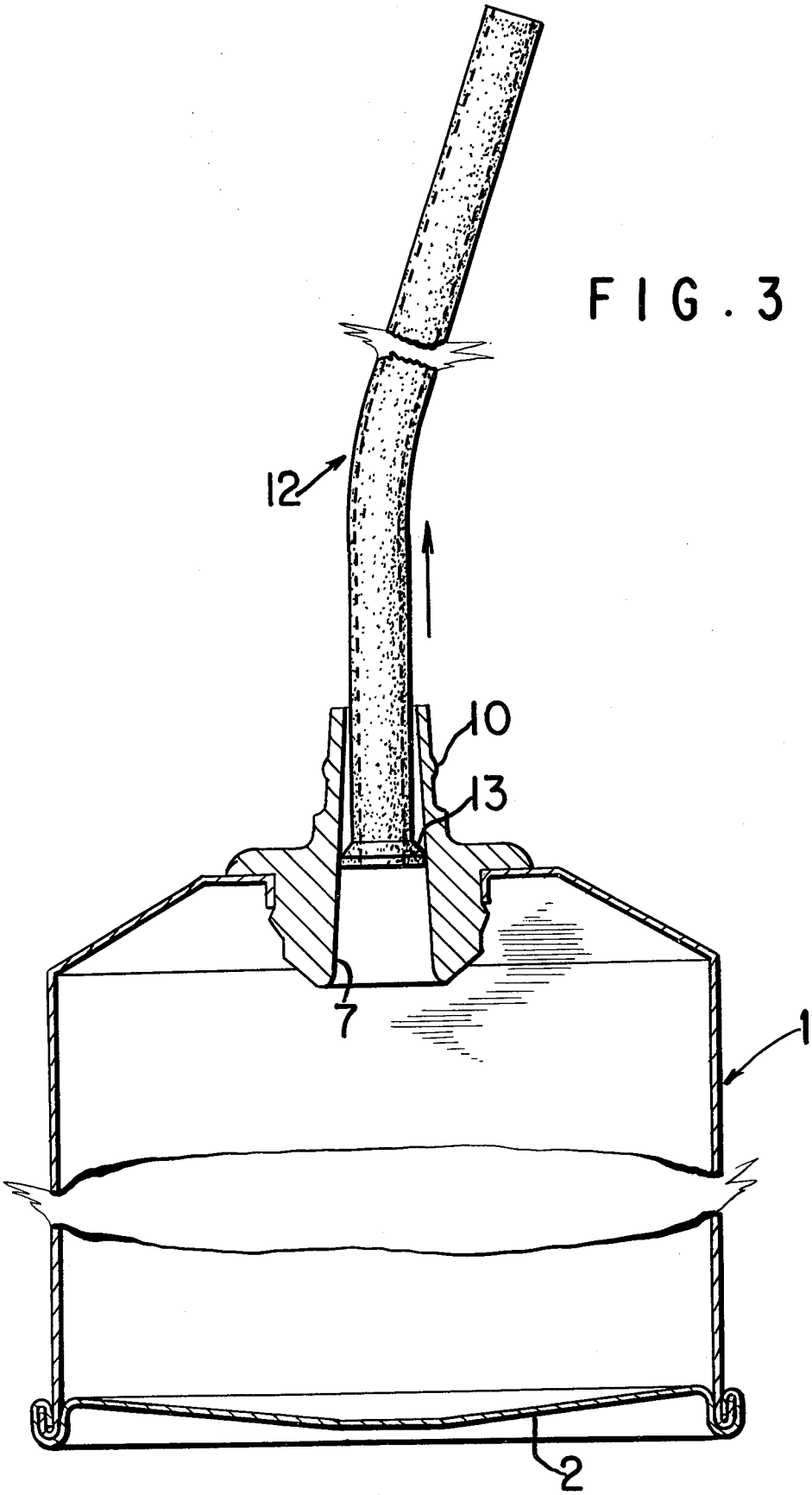
FIG. 3 is a sectional view of the container ready for use.

As may be seen in FIG. 3, the delivery tube now extends out of the can, a distance substantially equal to the height of the can. Dispensing of the can contents is now achieved by pressing inwardly the diaphragm 2.

Figure 4:
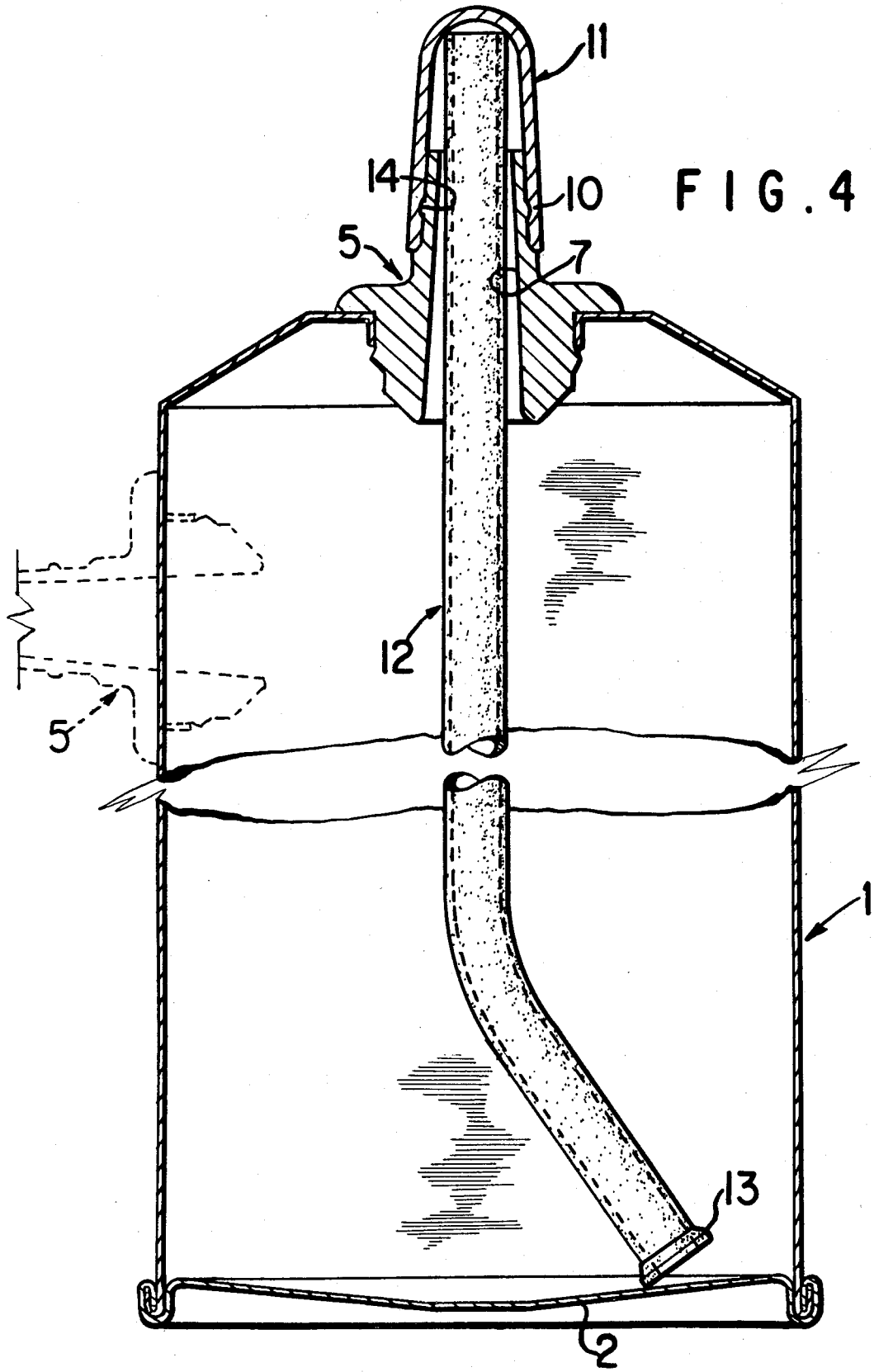
FIG. 4 is a sectional view of the container after use, reclosed by a cap.

After use, in order to store the can in as small a space as possible and to re-seal it against spillage, the delivery tube is simply pushed back into the can to the position shown in FIG. 2, and the cap 11 is then placed on the upper end of delivery tube 12. The cap 11 is then urged towards the insert 3 so that the circumferential rib 10 engages the internal groove 14 on the cap, sealing and retaining the cap on the tube 5 as seen in FIG. 4. The cooperating rib 10 and groove 14 must overcome any resilient force exerted on the cap 11 by the delivery tube 12. Other means may be used to retain the cap 11 to the tube 5, for example, a screw thread.

Various modifications or alterations may be made to the above-described embodiment, for example, the can 1 may be of metal or flexible plastic material. The insert 3 may be positioned at the top, or in a side of the can 1 to provide a "pistol" effect, as is indicated in phantom in FIG. 4.

The bore diameter of tube 12 is selected according to the physical properties, such as viscosity and the like, of the liquid with which the container is to be used. The length of the tube 12 is sufficient so that it may extend an end portion out of the tapering tube 5 after cutting, the extended end portion being grippable for pulling to its fully extended position.

The internal dimension of the upper end of the tapered bore 7, and of parallel portion 8*a*, should be sufficiently close to the external diameter of tube 12 so that, when tube 12 is pulled to its extended position, any liquid clinging to its exterior is wiped off and falls back into the interior of the can 1. The position of the cut between the lines A and B will determine the diameter of the smaller end of bore 7, and so indicating lines A and B may be formed on the tube 5 to ensure that the user does not remove an excessive amount of tube 5.

Alternatively, a larger cap may be used which permits part of the delivery tube 12 to extend above the cut end of tapered tube 5. The delivery tube will then be in the position shown in FIG. 2 when this type of cap is applied after use to re-seal the container. This cap may also engage not on the sidewall of the tapering tube, but on the base 5*a* of insert 3, thus making the exact location of the cut across the tube less critical to the re-application of the cap. To prevent loss, the cap and insert may be integrally formed, connected by a flexible strap.

In a further embodiment of the device, not illustrated, the bore 7 is made parallel-sided and the enlargement 13 of the tube 12 is given a much reduced taper, i.e., is extended further along the tube 12. In this way, as the tube 12 is pulled out of the can 1, the enlargement will act as a seal between the tube and the inner end of the parallel tube 7.

In the case where the container is made from plastic material, the bore 7 and tube 5 may be formed integrally therewith.

What is claimed is:

1. In a dispensing container for liquids, having a reservoir and a one-piece exit nozzle which is an outwardly extending tube with an outwardly diminishing tapered bore, and provided with a closure at the outer end, the improvement comprising a resilient delivery tube in a resiliently bent position within the reservoir, a first end of said delivery tube abutting an internal surface of the reservoir and a second end of said delivery tube extending into the tapered bore of the exit nozzle and abutting the closure thereof, the length of said delivery tube being greater than the distance between the points of abutment so that said tube is held in a flexed condition whereby upon removal of the closure from the nozzle the resiliency of said delivery tube forces said second end to protrude outwardly from the nozzle; and an enlarged portion defined on said delivery tube adjacent said first end whereby when said delivery tube is pulled outwardly from the reservoir, said enlarged portion engages the internal surface of the tapered bore forming a seal therebetween.

2. An improved dispensing container as defined in claim 1, comprising a tapered portion at said first end of the delivery tube which engages said tapered bore in said nozzle.

3. An improved dispensing container as defined in claim 2, further comprising a second closure adapted to re-seal said container.

4. An improved dispensing container as defined in claim 1, in which said reservoir comprises a metal container having at least one flexible wall.

* * * * *